US007333875B2

(12) United States Patent
Chuang et al.

(10) Patent No.: US 7,333,875 B2
(45) Date of Patent: Feb. 19, 2008

(54) METHOD OF PREDICTING CMP REMOVAL RATE FOR CMP PROCESS IN A CMP PROCESS TOOL IN ORDER TO DETERMINE A REQUIRED POLISHING TIME

(75) Inventors: Yen Chuang, Taipei (TW); Ming-Sen Chen, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 355 days.

(21) Appl. No.: 10/999,011

(22) Filed: Nov. 29, 2004

(65) Prior Publication Data

US 2006/0116785 A1 Jun. 1, 2006

(51) Int. Cl.
*G06F 19/00* (2006.01)
*H01L 21/302* (2006.01)

(52) U.S. Cl. ..... 700/121; 438/692

(58) Field of Classification Search ..... 700/121
See application file for complete search history.

(56) References Cited

U.S. PATENT DOCUMENTS

| | | | | |
|---|---|---|---|---|
| 6,514,861 | B1 | 2/2003 | Yang et al. | 438/690 |
| 6,564,116 | B2 * | 5/2003 | Wang et al. | 700/121 |
| 6,884,147 | B2 * | 4/2005 | Toprac | 451/5 |

* cited by examiner

*Primary Examiner*—Ryan A. Jarrett
(74) *Attorney, Agent, or Firm*—Thomas, Kayden, Horstemeyer & Risley

(57) ABSTRACT

A method of predicting CMP removal rate for CMP process in a CMP process tool. The method predicts CMP removal rates for CMP processes without polishing additional control wafers. The CMP process performed by the CMP process tool can be easily transferred accordingly, such that uptime of the CMP process tool is increased. In addition, number of control wafers used and production costs are also reduced.

12 Claims, 6 Drawing Sheets

METHOD OF PREDICTING CMP REMOVAL RATE FOR CMP PROCESS IN A CMP PROCESS TOOL IN ORDER TO DETERMINE A REQUIRED POLISHING TIME

BACKGROUND

The present invention relates to semiconductor technology, in particular to a method of predicting chemical mechanical polishing (CMP) removal rates for CMP processes in a CMP process tool.

CMP process is commonly used to planarize the surfaces of insulating film and conductive film on a semiconductor substrate.

Polishing of materials such as silicon, silicon dioxide, tungsten, copper or aluminum is generally accomplished using a polishing pad in combination with suitable polishing slurry.

In addition, a wafer carrier is used in the polishing to hold the wafer such that the wafer faces the polishing pad dispersed with polishing slurry. The polishing pad is supported by a rotary or linear moving platen.

In general, a CMP process involves mechanically polishing a semiconductor wafer by holding and rotating the wafer against a polishing platen under different control parameters, such as a linear or rotational speed of a polishing pad, downward force by a wafer carrier, polishing time, flow rate and chemical conditions of CMP slurry. However, these parameters usually change with different CMP processes such that different removal rates are required. The obtained removal rate is essential for a CMP process and is applied to the CMP process to determine the necessary polishing time for the process.

Normally, a CMP process tool only performs one distinct CMP process such as inter-layer dielectric (ILD), inter-metal dielectric (IMD), or shallow trench isolation (STI) CMP process. The CMP process tool can also perform other CMP processes polishing materials with similar physical properties (e.g., dielectric material or metal). Thus, the CMP process performed by the CMP process tool can be transferred to reduce the WIP (wafer in process) of other certain CMP processes if necessary. A new removal rate is therefore needed when a CMP process performed by the CMP process tool is transferred.

FIG. 1 is a flowchart showing the process of transferring CMP processes in a CMP process tool according to the prior art. First, in step S1, at least one control wafer is polished under a first process with certain control parameters by a CMP process tool. The thickness of the control wafer is measured before and after the polishing by a measurement device and a thickness difference is obtained. Next, in step S2, a removal rate of the first process is obtained by calculating the process time and thickness difference of the control wafer. Next, step S3 determines whether the removal rate is acceptable by the first process. If so, the obtained removal rate is applied to the CMP process tool that performs the first process accordingly, as indicated in S4. If not, an operator (equipment engineer or process engineer) is informed and the process of the CMP process tool is halted and checked until the problem has been rectified, as indicated in step S5. After the engineer's inspection in step S5, steps S1~S3 are repeated to obtain another removal rate for the first process to ensure that the problems have been rectified. Next, step S6 determines whether other incoming product wafers require polishing by the CMP process tool. If not, the CMP process is finished and the CMP process tool becomes idle, as indicated at step S7. Next, step S8 determines whether the incoming product wafers require the same process. If so, the CMP process tool continues to polish these wafers, as indicated in S9. If the incoming product wafers require different process with different control parameters, a new removal rate is needed to apply to the CMP process tool to determine a new process time and allows the process performed by the CMP process tool to be transferred. Thus, in step S10, at least one control wafer is polished under the control parameters of a new process by the same CMP process tool. The thickness of the control wafer is measured before and after polishing by a measurement device and a thickness difference is obtained. Next, in step S11, a removal rate is obtained by calculating the process time of the control parameters of the new process and the control wafer's thickness difference by the new process. Next, step S12 determines whether the new removal rate meets the process specification of the new process. If so, the newly obtained removal rate is applied to the CMP process tool, which starts the new process to polish incoming product wafers of the new CMP process, as indicated in S13. If not, an operator (equipment engineer or process engineer) is informed and the process of the CMP process tool is halted and checked until the problem has been rectified, as indicated in step S14. After the engineer's inspection in step S14, steps S10~S12 are repeated to obtain another removal rate for the new process to ensure that the problems have been rectified and transfer of the CMP process is done.

Thus, it is necessary to perform another control wafer polishing sequence (monitor) as illustrated in steps S10~S12 during transfer of the CMP process in a CMP process tool. The repeated monitor sequence requires considerable time to treat (preparing control wafers, measuring the thickness and particle condition before and after the CMP process) the control wafer, reducing real process time for polishing product wafers in a CMP process tool. In addition, the number of control wafers used in the second monitor sequence increases the process cost.

In U.S. Pat. No. 6,514,861, Yang et al. teach a semiconductor process for manufacturing at least one wafer that effectively controls process time by varying weighting factors. Prediction of the removal rate of chemical mechanical polishing that precisely controls polishing time is achieved by first providing a previously predicted process rate and a previously measured process rate by a process tool. Next, a presently predicted process rate is obtained by a first linear equation having a first variable weighting factor using the previously predicted and previously measured process rates as variables. Next, a process time is obtained according to the currently predicted process rate and a predetermined target to input to the process tool. Finally, the wafer is manufactured according to the process time by the process tool. U.S. Pat. No. 6,514,861, however, merely provides a method for precisely controlling the polishing time of a subsequent wafer of the same CMP process.

Accordingly, what is called for is a method of predicting a removal rate of subsequent CMP process and a method of transferring CMP processes in a CMP process tool in order to conserve process downtime, control wafers used, and resultant costs.

SUMMARY

Accordingly, an object of the invention is to provide a method of predicting CMP removal rates that overcomes the difficulties discussed in prior art systems and processes.

Another object of the invention is to provide a method of predicting CMP removal rates for a CMP process tool without requiring an additional polishing procedure.

Thus, the method of predicting CMP removal rates in a CMP process tool comprises the steps of obtaining a measured removal rate by performing a first CMP process in a CMP process tool, providing a conversion factor and multiplying the measured removal rate by the conversion factor to generate a predicted removal rate.

In addition, a method of transferring CMP processes in a CMP process tool comprises the steps of performing a first CMP process by a CMP process tool, polishing at least one control wafer to obtain a measured removal rate, and performing a second CMP process different from the first CMP process, performance of which comprises multiplying the measured removal rate by the conversion factor, applying the predicted removal rate to the CMP process tool in order to determine a required polishing time, and completing the second CMP process.

The conversion factor of the present invention can be obtained by choosing a control parameter of the first CMP process as a variable and keeping other control parameters fixed, varying the values of the variable and polishing at least one control wafer to obtain a correlative expression between the variable and a removed thickness of the control wafer, and choosing another control parameter of the first CMP process as a new variable until individual correlative expressions between each of the control parameters and a removed thickness of the control wafer are obtained, and multiplying the correlative expressions to obtain a work function, and providing a second CMP process having the same types of control parameters as the first CMP process, and respectively applying a plurality of known values of the first CMP process and the second CMP process to the work function to obtain a first result and a second result respectively, and dividing the second result by the first result to obtain a conversion factor.

Moreover, the present invention also provides a work function for a rotary CMP process tool to calculate a conversion factor for transferring CMP process in the CMP process tool. The work function follows:

$$F(X,Y,Z)=[1.223-0.605e^{-(X-3.4)/2.117)}]*[1.085-0.302e^{-(Y-80/98.39)}]*[1.187-0.719e^{-(Z-40/66.304)}].$$

Where X is a first type of control parameter, Y is a second type of control parameter and Z is a third type of control parameter.

The first type of control parameter can be downward force by a wafer carrier, the second type of control parameter can comprise a flow rate of CMP slurry, and the third type of control parameter can comprise a rotational speed of a polishing pad.

A detailed description is given in the following embodiments with reference to the accompanying drawings.

DESCRIPTION OF THE DRAWINGS

The present invention can be more fully understood by reading the subsequent detailed description and examples with references made to the accompanying drawings, wherein.

DETAILED DESCRIPTION

Figure 1:
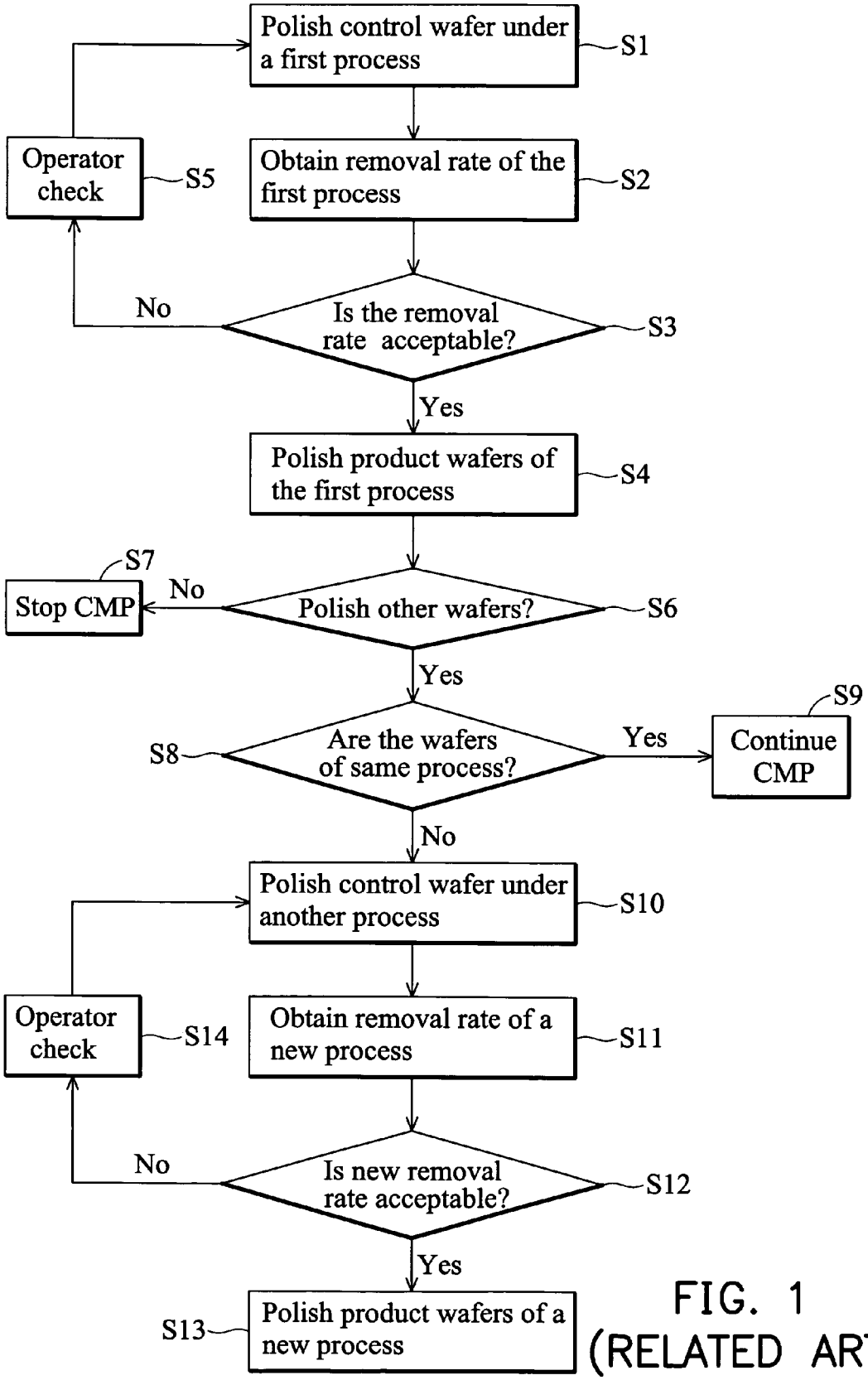
FIG. 1 (RELATED ART)
FIG. 1 is a flowchart showing the process of transferring CMP processes of a CMP process tool according to the prior art.
Figure 2:
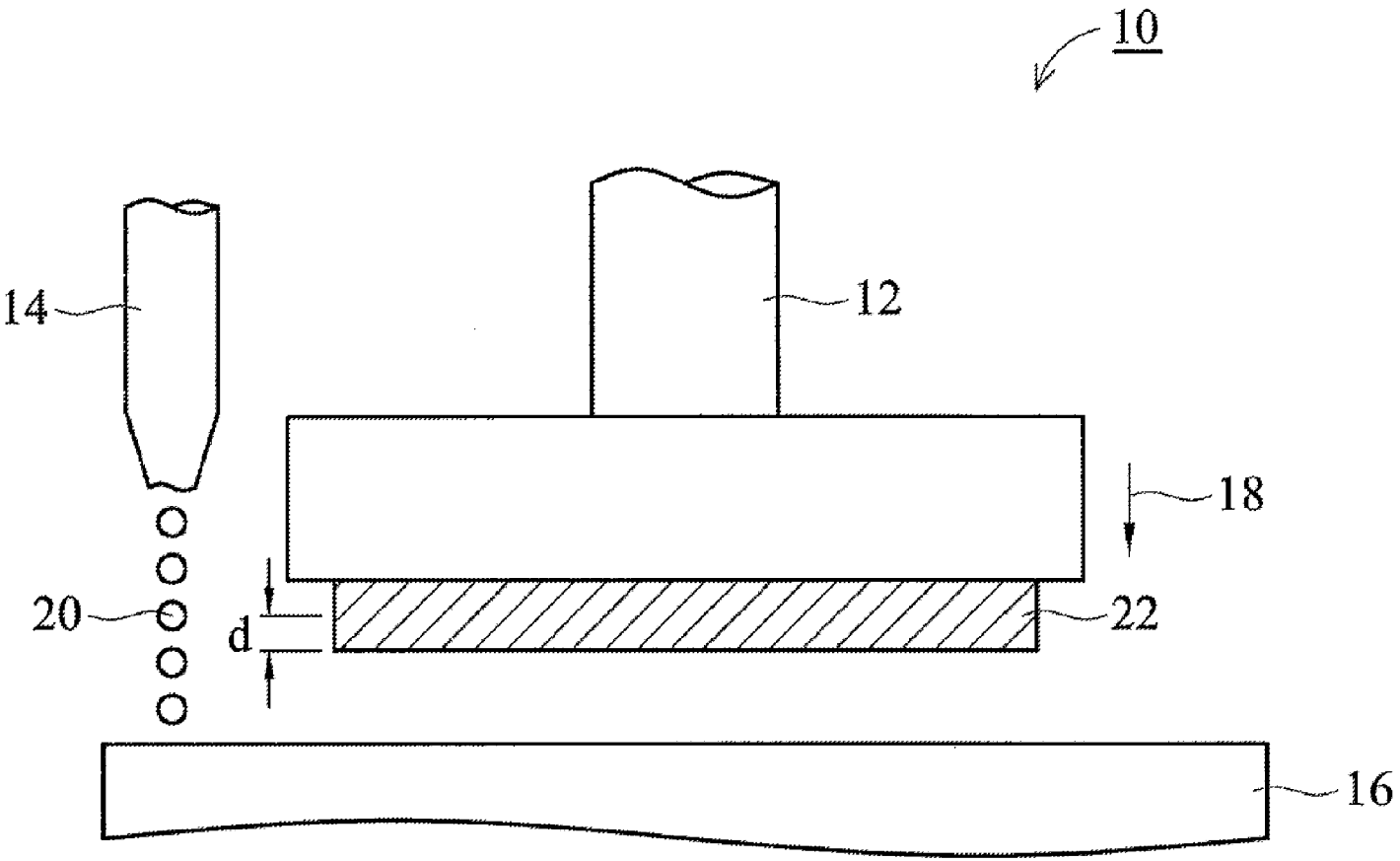
FIG. 2 is a sectional diagram showing an exemplary chemical mechanical polishing process tool.

FIG. 2 is an exemplary chemical mechanical polishing (CMP) process tool. The CMP process tool 10 includes a wafer carrier 12, a slurry supply 14, and a polishing pad 16. The wafer carrier 12 is positioned above the polishing pad 16 and exerts downward force 18 during a CMP process. In addition, the slurry supply 14 supplies suitable CMP slurry 20 at suitable flow rate during a CMP process. The polishing pad 16 is positioned on a platen (not shown) that moves either linearly or rotationally. The predetermined polishing thickness d of the wafer 22 is controlled by a controller (not shown) in the CMP tool 10 by applying a predetermined removal rate obtained by polishing at least one control wafer to the CMP process tool 10 such that the process time to remove the thickness d is determined.

Method of Transferring CMP Processes in a CMP Process Tool

Figure 3:
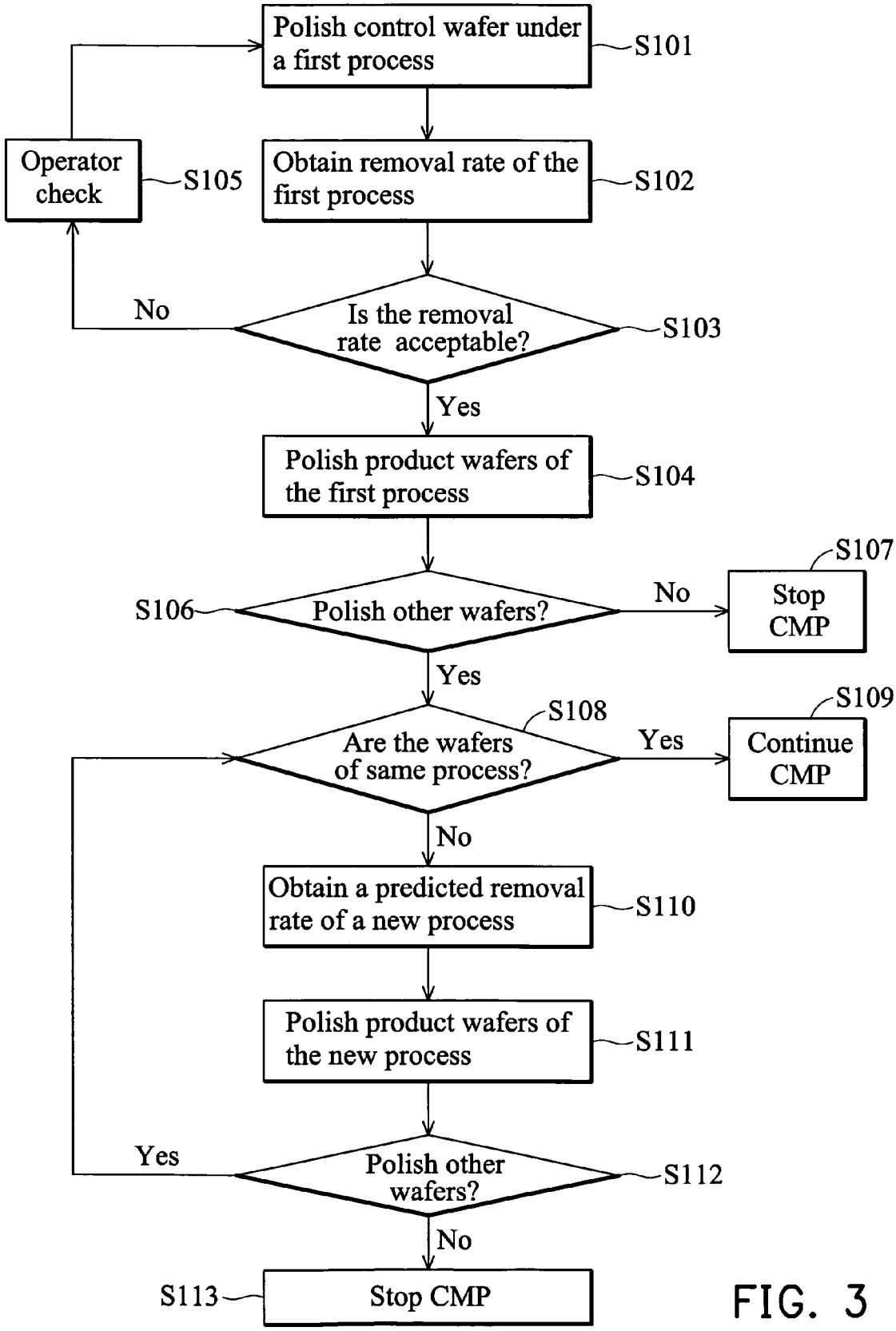
FIG. 3 is a flowchart showing the process of transferring CMP processes of a CMP process tool according to an embodiment of the present invention.

FIG. 3 is a flowchart showing the process of transferring CMP processes in a CMP process tool according to an embodiment of the present invention. First, in step S101, at least one control wafer is polished under a first process having a plurality of control parameters by a CMP process tool. As will be described in more detail below, control parameters may include the moving speed (linear or rotational) of the CMP process, the force by the wafer carrier, temperature, chemical conditions of the slurry, etc. The first process can comprise an inter-layer dielectric (ILD), inter-metal dielectric (IMD), or shallow trench isolation (STI) CMP process for polishing wafers coated with dielectric materials such as silicon dioxide, BPSG, or low-k materials. The first process can also be a metal CMP process for polishing wafers coated with metal such as copper, tungsten or aluminum. In addition, the thickness of the control wafer is measured before and after the process by a measurement device, to obtain a thickness difference. Next, in step S102, a measured removal rate of the first process is obtained by calculating the process time and the control wafer's thickness difference. Next, step S103 determines whether the measured removal rate is acceptable by the first process. If so, the measured removal rate is applied to the CMP process tool that performs the first process to polish product wafers, as indicated in S104. If not, an operator (equipment engineer or process engineer) is informed and the process of the CMP process tool is halted and checked until the problem has been rectified, as indicated in step S105. After the engineer's inspection in step S105, steps S101~S103 are repeated to obtain another removal rate for the first process to ensure that the problems have been rectified. Next, step S106 determines whether other incoming product wafers require polishing by the CMP process tool. If not, the CMP process is finished and the CMP process tool becomes idle, as indicated at step S107. If so, step S108 determines whether the incoming product wafers require the same process. If so, the CMP process tool continues to polish these wafers, as indicated in S109. If the incoming product wafers require different process with different values of control parameters, a new removal rate is needed to apply to the CMP process tool to determine a new process time and allows the process performed by the CMP process tool to be transferred. Thus, in step S110, a predicted removal rate of the new process can be generated by multiplying the measured removal rate of the first process by a conversion factor. Next, in step S111, the predicted removal rate is applied to the CMP process tool, which starts the new process to polish incoming product wafers of the new CMP process and the CMP process performed by the CMP process tool is transferred. Thus, incoming product wafers of the new process can be polished by the CMP process tool with a shortened idle time than the conventional process. Next, step S112 determines whether other wafers are incoming. If not, the CMP is finished, as indicated at step S113. If so, steps S108~S112 or steps S108~S109 are repeated.

Method of Predicting CMP removal Rates

Figure 4:
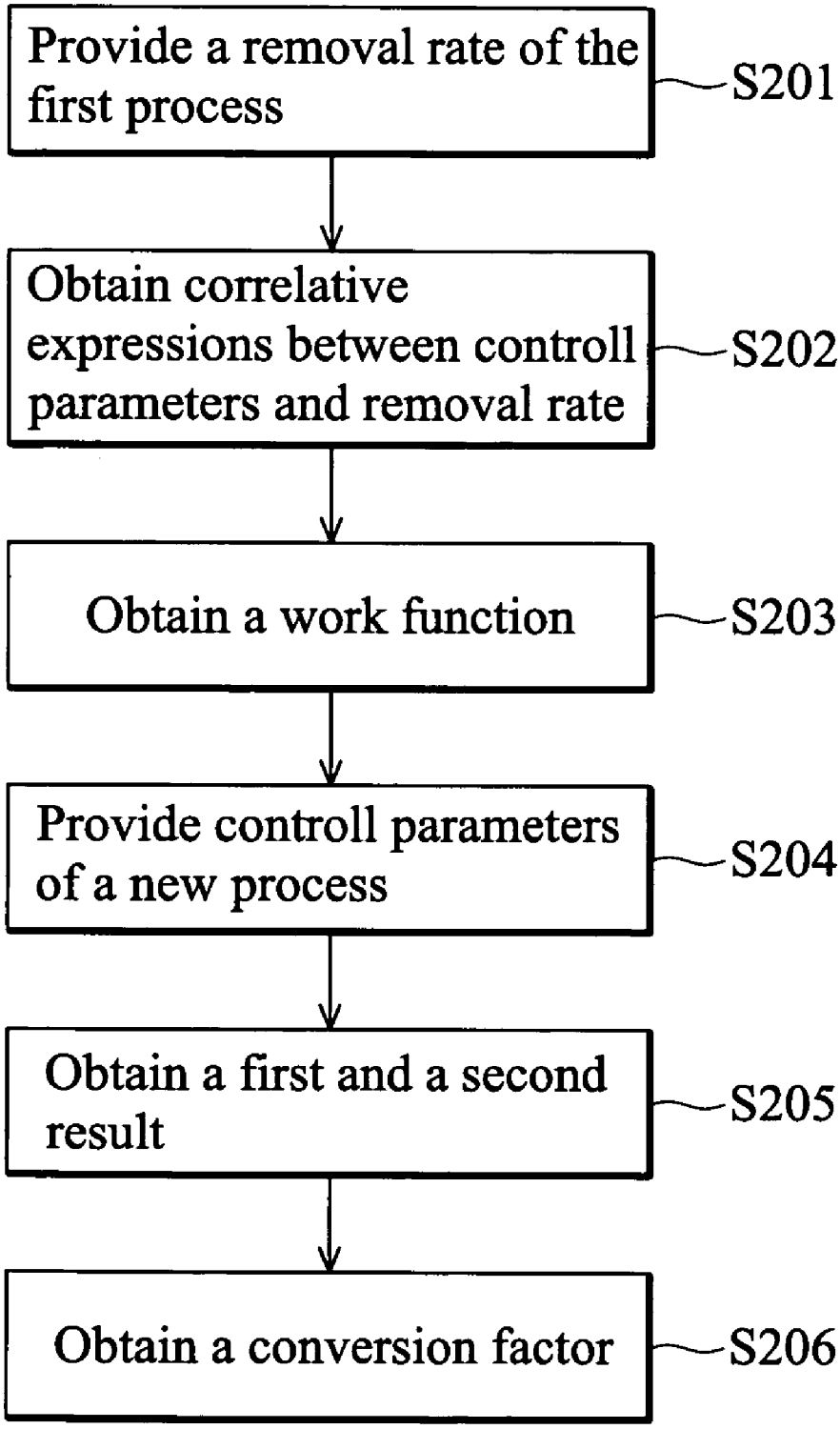
FIG. 4 is an exemplary flowchart of step S110 in FIG. 3.

The key step S110 of the method of transferring CMP processes in FIG. 3 is illustrated in more detail by an exemplary flowchart shown in FIG. 4.

First, in step S201, a measured removal rate such as that mentioned of the first CMP process is provided. Next, in step S202, correlative expressions between control parameters and a removed thickness of the control wafer are obtained by the following steps:

(a) a control parameter of the first CMP process is chosen as a variable and other control parameters are kept fixed;

(b) a correlative expression between the variable and a removed thickness of the control wafer is obtained by changing values of the variable and polishing at least one control wafer.

(c) another control parameter is then chosen and step (a) and (b) are repeated until individual correlative expressions between each of the control parameters and a removed thickness of the control wafer are obtained.

Next, in step S203, a work function between the overall CMP removal rate and the control parameters of a CMP process is then obtained by multiplying all the mentioned correlative expressions. Next, in step S204, control parameters of a new CMP process are provided for prediction of CMP removal rates. Next, in step S205, the work funtion has applied to it a plurality of predetermined values of the control parameters in the first process and the new process, and a first result and a second result are then obtained respectively. Next, in step S206, a conversion factor for predicting removal rates of different CMP process is obtained by dividing the second result by the first result without the need for additional polishing operations.

Generally, the control parameters of CMP process can comprise a moving speed (linear or rotational) of a polishing pad, downward force by a wafer carrier, temperature, and chemical conditions and flow rate of CMP slurry. However, a moving speed of a polishing pad, downward force by a wafer carrier and flow rate of CMP slurry are the three control parameters that most strongly influence measured removal rate. Thus, the method of predicting CMP removal rates according to the present invention can choose from a variety of control parameters, including the three mentioned control parameters as main variables to determine the correlative expressions when obtaining the work function.

The method of transferring CMP processes in a CMP process tool according to an embodiment of the present invention is suitable for polishing similar material of similar physical properties (dielectric material or metal). Thus, a process of a CMP process tool allows CMP process transfer without additional monitor sequence. Uptime of the CMP process tool is thus increased, and both control wafer quantities used and production costs are also reduced.

Results of Transferring CMP Processes in a Rotary CMP Process Tool

A plurality of rotary CMP process tools, for example Mirra CMP equipment manufactured by Applied Material, performing dielectric CMP processes were provided. Normally, each Mirra here performs one of the ILD, IMD, or STI CMP process and transfers to other process only if necessary. Types of control parameters mainly affecting the removal rate in the mentioned processes are rotation speed of the polishing pad, downward force by the wafer carrier and flow rate of CMP slurry. Example values of these control parameters as used in each process are shown in table 1.

TABLE 1

| | Rotational speed(rpm) | Downward force (psi) | Flow rate of slurry(ml/min) |
|---|---|---|---|
| ILD CMP | 63 | 4 | 150 |
| STI CMP | 63 | 4.2 | 200 |
| IMD CMP | 108 | 4.6 | 100 |

Using Mirra CMP equipment as shown (Mirra A hereinafter) performing ILD CMP process as an example, the measured removal rate of the ILD CMP process was obtained by a periodic (daily, semi-daily or controlled by number of wafers processed) monitoring sequence. To transfer the process in Mirra A from ILD into IMD or STI CMP process, a conversion factor is required. The conversion factor can be obtained according to the method of predicting CMP removal rates of the present invention as previously illustrated.

Figure 5:
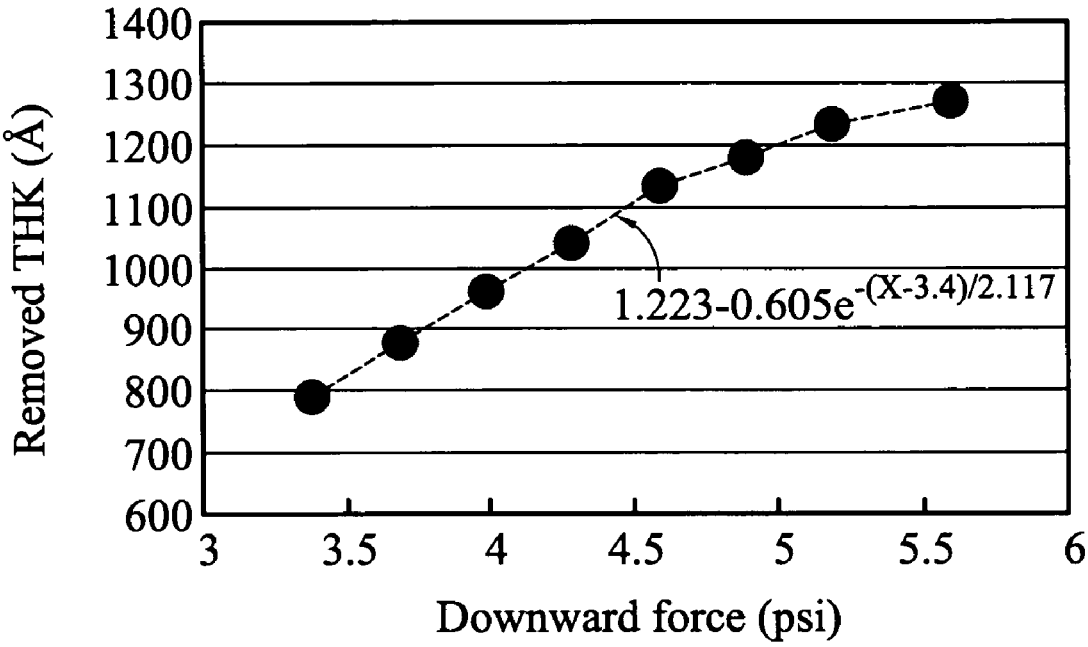
FIGS. 5 to 7 show individual correlative expressions between individual control parameters and a removed thickness of the control wafer.

First, a first type of control parameter, downward force by the wafer carrier, was chosen as a variable and other control parameters were kept fixed (rotational speed at 63 rpm and flow rate of CMP slurry at 150 ml/min) and a correlative expression between the downward force and a removed thickness was obtained by changing different values (3~6 psi) of the downward force and polishing at least one control wafer. In FIG. 5, a correlative expression between a removal rate (RR) and downward force by the wafer carrier (X) in Mirra A by a mathematical model such as exponential decay was obtained and is illustrated here as RR $\alpha$ $1.223-0.605e^{-(X-3.4)/2.117}$.

Figure 6:
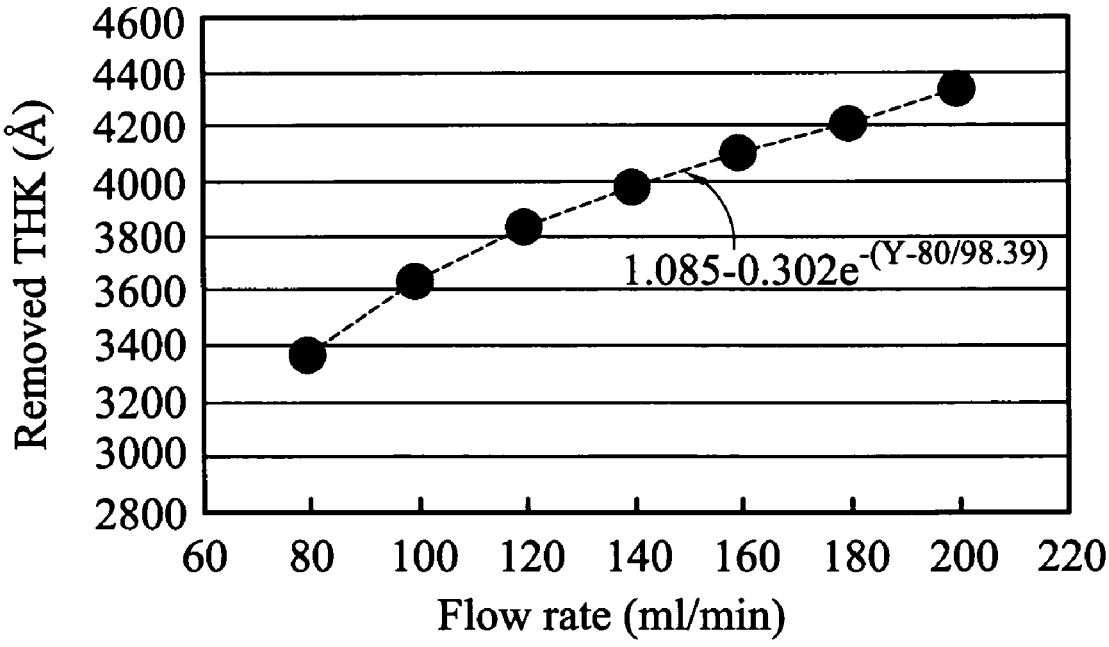

Next, a second type of control parameter, flow rate of CMP slurry, for example of the three mentioned control parameters, was chosen as a variable and other control parameters were kept fixed (rotational speed at 63 rpm and downward force at 4.2 psi) and a correlative expression between the flow rate of CMP slurry and a removed thickness was obtained by changing different values (50~250 ml/min) of the flow rate of CMP slurry and polishing at least one control wafer. In FIG. 6, a correlative expression between a removal rate (RR) and flow rate of CMP slurry (Y) in Mirra A correlated by a mathematical model such as exponential decay was obtained and is illustrated here as RR $\alpha 1.085-0.302e^{-(Y-80/98.39)}$.

Figure 7:
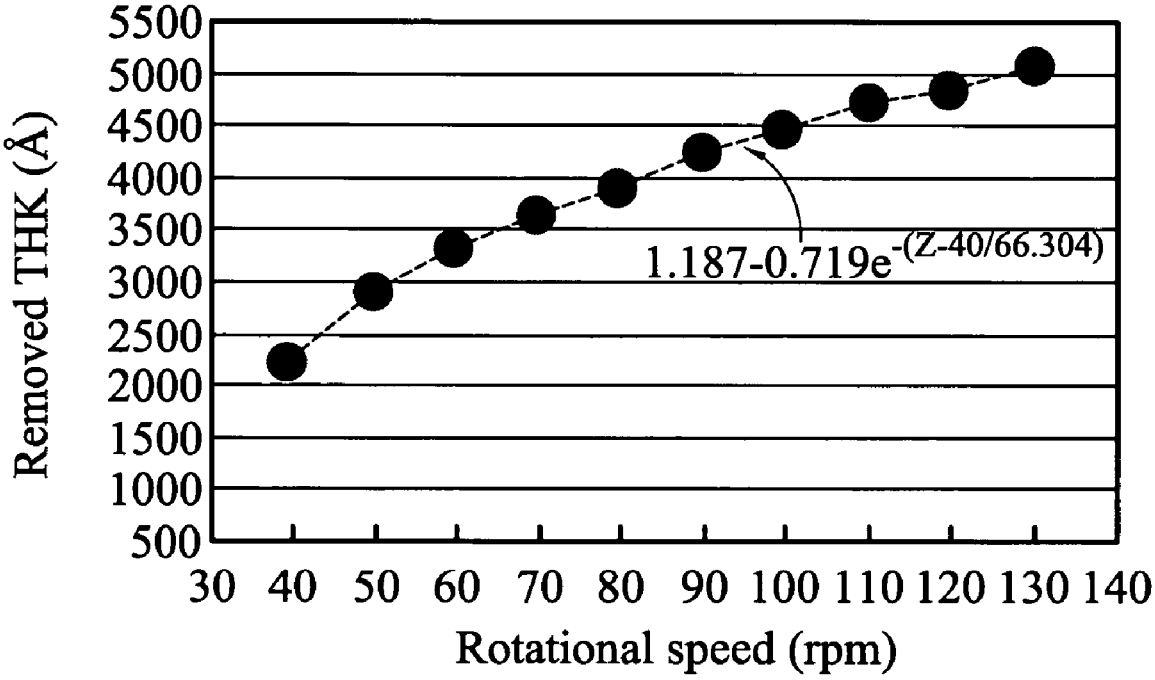

Next, the third type of control parameter, rotational speed of the pad, for example of the three mentioned control parameters, was chosen as a variable and other control parameters were kept fixed (flow rate of CMP slurry at 150 ml/min and downward force at 4.2 psi) and a correlative expression between the rotational speed and a removed thickness was obtained by changing different values (30~130 rpm) of the rotational speed of the pad and polishing at least one control wafer. In FIG. 7, a correlative expression between a removal rate (RR) and rotational speed of the pad (Z) in Mirra A was obtained by a mathematical model such as exponential decay and is illustrated here as RR $\alpha$ $1.187-0.719e^{-(Z-40/66.304)}$.

Thus, a work function F(X,Y,Z) between the removal rate and the main control parameters affecting the CMP removal rate was obtained and is illustrated as formula (1) by multiplying the three mentioned correlative expressions.

$$F(X,Y,Z)=[1.223-0.605e^{-(X-3.4)/2.117)}]*[1.085-0.302e^{-(Y-80/98.39)}]*[1.187-0.719e^{-(Z-40/66.304)}] \quad (1)$$

Then the work function had applied to it values of control parameters used in ILD CMP process and in the CMP process (as shown in Table 1.) to be transferred (STI CMP or IMD CMP for example), and a first result and a second result were then obtained respectively.

Next, the conversion factor for predicting removal rates for different CMP process was then obtained by dividing the second result of the CMP process (STI CMP or IMD CMP here) to be transferred by the first result of the original CMP process (ILD CMP here). Table 2 shows a result of the conversion factor for transferring CMP process from ILD CMP to STI CMP or IMD CMP. Normally, the conversion factor is preferably between substantially 0.5 and substantially 2.

TABLE 2

| | Conversion factor |
|---|---|
| STI CMP | 1.12 |
| IMD CMP | 1.41 |

Thus, the removal rate for the transferred CMP process (STI CMP or IMD CMP for example) in Mirra A can be obtained by multiplying the measured removal rate of the performed process (ILD CMP for example) in Mirra A obtained by a periodic (daily, semi-daily or by number of wafers processed) monitoring sequence by the conversion factor from table 2. A predicted removal rate is then obtained and the process performed by the Mirra A is transferred by applying the predicted removal rate into it. Thus, the process performed by Mirra A is easily transferred from ILD CMP to STI CMP or IMD CMP without any additional polishing. Uptime of Mirra A is increased and the number of control wafers used and production costs of the Mirra A are also reduced.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method of transferring chemical mechanical polishing (CMP) processes in a CMP process tool comprising the steps of:

a. performing a first CMP process by a CMP process tool, polishing at least one control wafer to obtain a measured removal rate; and b. performing a second CMP process different from the first CMP process, performance of which comprises:

multiplying the measured removal rate by a conversion factor to obtain a predicted removal rate;

applying the predicted removal rate to the CMP process tool in order to determine a required polishing time; and completing the second CMP process;

wherein the conversion factor is obtained by the steps of:

a. choosing a control parameter from control parameters of the first CMP process as a variable and keeping other control parameters of the control parameters fixed, varying values of the variable and polishing the at least one control wafer to obtain a correlative expression between the variable and a removed thickness of the at least one control wafer;

b. choosing another control parameter of the first CMP process as a new variable and repeating step (a) until individual correlative expressions between each of the control parameters and a removed thickness of the at least one control wafer are obtained;

c. multiplying the correlative expressions to obtain a work function;

d. providing the second CMP process having the same types of control parameters as the first CMP process;

e. respectively applying a plurality of known values of the first CMP process and the second CMP process to the work function to obtain a first result and a second result respectively; and f. dividing the second result by the first result to obtain the conversion factor.

2. The method as claimed in claim 1, wherein the first CMP process and the second CMP process are processes of polishing wafers coated with materials having similar physical properties.

3. The method as claimed in claim 1, wherein the first CMP process is an inter-layer dielectric (ILD) CMP process.

4. The method as claimed in claim 1, wherein the second CMP process is an inter-metal dielectric (IMD) CMP process or shallow trench isolation (STI) CMP.

5. The method as claimed in claim 1, wherein the conversion factor is between 0.5 and 2.

6. The method as claimed in claim 1, wherein the CMP process tool is a rotary CMP process tool.

7. The method as claimed in claim 1, wherein the work function is:

$$F(X,Y,Z)=[1.223-0.605e^{-(X-3.4)/2.117)}]*[1.085-0.302e^{-(Y-80/98.39)}]*[1.187-0.719e^{-(Z-40/66.304)}];$$

where X is a first type of control parameter, Y is a second type of control parameter and Z is a third type of control parameter.

8. The method as claimed in claim 7, wherein the first type of control parameter is downward force by a wafer carrier.

9. The method as claimed in claim 7, wherein the second type of control parameter is a flow rate of CMP slurry.

10. The method as claimed in claim 7, wherein the third type of control parameter is a rotational speed of a polishing pad.

11. The method as claimed in claim 1, wherein the correlative expressions are exponential expressions.

12. The method as claimed in claim 1, wherein the known values of the first CMP process and the second CMP process are downward force between 3.5 psi and 5.5 psi, CMP slurry flow rate between 80 ml/min and 200 ml/min, and rotational speed of a polishing pad between 40 rpm and 130 rpm.

* * * * *